United States Patent [19]

Watanabe

[11] 4,445,074

[45] Apr. 24, 1984

[54] STARTING CIRCUITS FOR DISCHARGE LAMPS

[75] Inventor: Yoshio Watanabe, Tokyo, Japan

[73] Assignee: Hitachi, Ltd., Tokyo, Japan

[21] Appl. No.: 318,110

[22] Filed: Nov. 4, 1981

[30] Foreign Application Priority Data

Nov. 7, 1980 [JP] Japan ..... 55-158581[U]

[51] Int. Cl.[3] ..... H05B 41/14; H05B 41/16

[52] U.S. Cl. ..... 315/205; 315/DIG. 5; 315/243; 315/101; 315/94

[58] Field of Search ..... 315/205, 243, DIG. 5, 315/101, 107, 94; 363/59, 126

[56] References Cited

U.S. PATENT DOCUMENTS 4,045,708 8/1977 Neal ..... 315/DIG. 5 X
4,189,663 2/1980 Schmutzer et al. ..... 315/205
4,337,418 6/1982 Walz ..... 315/DIG. 5 X

FOREIGN PATENT DOCUMENTS 1358829 7/1974 United Kingdom ..... 315/205
1387842 3/1975 United Kingdom ..... 315/205

*Primary Examiner*—Eugene R. Laroche
*Assistant Examiner*—Vincent DeLuca
*Attorney, Agent, or Firm*—Antonelli, Terry & Wands

[57] ABSTRACT

A starting circuit for discharge lamps includes a current limit device, a full wave rectifier circuit and a Cockcraft-Walton's circuit which are connected between a d.c. discharge lamp having a cathode and an anode and the input terminals of an a.c. power source. Moreover, the Cockcraft-Walton's circuit is constructed by sharing a rectifier with the full wave rectifier circuit and a preheating circuit is provided for the cathode and includes another rectifier of the full wave rectifier circuit and a switching device.

16 Claims, 2 Drawing Figures

STARTING CIRCUITS FOR DISCHARGE LAMPSBACKGROUND OF THE INVENTION

The present invention relates to improvements in a starting circuit for discharge lamps, and more particularly to reduction in the time for ignition of a starting device for operating a discharge lamp, which is to be operated on direct current and which is equipped with a preheat type hot cathode, with an a.c. power source.

A glow starting switch is usually used to start a discharge lamp such as a fluorescent lamp. Nevertheless, the glow starting switch has a disadvantage that it takes several times to start the discharge lamp. Therefore, a rapid-start ballast capable of shortening the time for the starting operation has been put into practice. However, the fluorescent lamp to be used therewith has to be one having a special construction. Moreover, such rapid-start ballast has its size enlarged and its cost raised. Therefore, there have been proposed a variety of rapid-start starters which are so constructed of semiconductor devices as to have a function superior to that of the glow starting switch. Nevertheless, it is the present state that all of those rapid-start starters are neither inexpensive nor sufficiently high in their reliability.

In recent years, on the other hand, from the standpoint of energy economy, there has been proposed the so-called "compact fluorescent lamp with screw in base", which is constructed by reducing the size of a fluorescent lamp intrinsically having a high efficiency in place of an incandescent lamp having a lower efficiency. Since the fluorescent lamps thus far described all use the glow starting switch as their starter, the time required for their ignitions is so remarkably longer than that for the incandescent lamp that they are sometimes hard to use for some applications. It is, therefore, very significant to use the rapid-start starter in that compact fluorescent lamp. However, the rapid-start starters, which have already been proposed, are still so expensive and little reliable that they can hardly be put into practical uses.

SUMMARY OF THE INVENTION

It is, therefore, an object of the present invention to provide an inexpensive starting circuit for discharge lamps such as the compact fluorescent lamps, which are suitable for use in place of incandescent lamps, said starting circuit being enabled to have practically the same time required for igniting the discharge lamps as that for the incandescent lamps.

In order to achieve the above-specified object, the starting circuit for discharge lamps according to the present invention is characterized by: a discharge lamp operated on direct current and including one cathode and at least one anode; a full wave rectifier circuit having its d.c. output terminal connection between the anode and said cathode; a current limit device connected between the a.c. input terminal of the full wave rectifier circuit and the input terminal of an a.c. power source; and a Cockcroft-Walton's circuit constructed by adding capacitors and a rectifier to one of the rectifiers of the full wave rectifier circuit.

By that characteristic construction of the present invention, there is provided a discharge lamp starting circuit which is capable of igniting discharge lamps within a short time and which is inexpensive and highly reliable.

DETAILED DESCRIPTION

Figure 1:
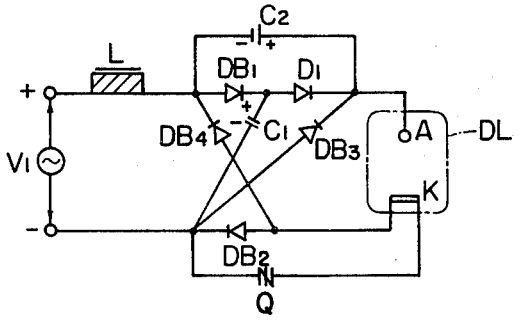
FIG. 1 is a circuit diagram showing a starting circuit for discharge lamps according to the present invention.

FIG. 1 shows the circuit construction of the discharge lamp starting circuit according to the present invention. In FIG. 1, a discharge lamp DL to be operated on direct current is equipped with one preheat type hot cathode K and at least one anode A. This d.c. discharge lamp DL is exemplified by a d.c. compact fluorescent lamp which is disclosed in Japanese Laid-Open Patent Publication No. 54-147672. Between the anode A and the hot cathode K of that d.c. discharge lamp DL, there is connected the d.c. output terminal of a full wave rectifier circuit which is constructed of diodes $DB_1$ to $DB_4$. Between the a.c. input terminal of that full wave rectifier circuit and the input terminal of an a.c. power source $V_1$, there is connected a current limit device which is constructed of a choke L. Moreover, the diode $DB_1$, a diode $D_1$ and capacitors $C_1$ and $C_2$ having small capacities provide a Cockcroft-Walton's circuit. On the other hand, the diode $DB_2$ and a switch device Q provide a circuit for preheating the hot cathode K. More specifically, the hot cathode K is connected in series with the switch device Q and in parallel with the diode $DB_2$ thereby to form the preheat circuit. Here, the switch device Q is made to have such a function as to experience self breakdown so that it is rendered conductive when the voltage applied thereto is higher than the discharge voltage of the discharge lamp DL and lower than the peak voltage of the a.c. power source $V_1$. An SSS (i.e., Symmetrical Silicon Switch) device can be utilized as the switch device Q. The aforementioned Cockcroft-Walton's circuit is constructed by sharing the diode $DB_1$ with the full wave rectifier circuit. As a result, the diode $D_1$ is added to the full wave rectifier circuit although this circuit is basically constructed of the diodes $DB_1$ to $DB_4$, as has been described hereinbefore. In fact, the full wave rectifier circuit may be considered to be constructed of the diodes $DB_1$ to $DB_4$ and the diode $D_1$. On the other hand, the Cockcroft-Walton's circuit may be considered to be constructed of the series circuit composed of the diode $DB_1$ and the diode $D_1$, the capacitor $C_1$ having a small capacity and connected between the connection point between them and one terminal of the a.c. power source $V_1$, and the capacitor $C_2$ having a small capacity and connected in parallel with that series circuit.

Next, the operations of the discharge lamp starting circuit thus far described will be described in the following. When the voltage of the a.c. power source $V_1$ to be applied to the input terminal thereof has the polarity shown in FIG. 1, an electric current flows through the closed circuit which is composed of the a.c. power source $V_1$, the choke L, the diode $DB_1$, the capacitor $C_1$ and the a.c. power source $V_1$. As a result, the capacitor $C_1$ is charged to the peak voltage of the a.c. power source $V_1$. Next, when the voltage of the a.c. power source $V_1$ has the opposite polarity to that shown, an electric current flows through the closed circuit which is composed of the a.c. power source $V_1$, the capacitor $C_1$, the diode $D_1$, the capacitor $C_2$, the choke L and the a.c. power source $V_1$. As a result, the capacitor $C_2$ is charged to a higher voltage than that of the a.c. power source $V_1$. On the other hand, the switch device Q forming a part of the preheat circuit is fed with the voltage of the a.c. power source $V_1$ as a result of the formation of the closed circuit which is composed of the a.c. power source $V_1$, the switch device Q, the hot cathode K, the diode $DB_4$, the choke L and the a.c. power source $V_1$. As a result, the switch device Q is rendered conductive at the predetermined voltage level, as has been described hereinbefore Accordingly, an electric current flows through the aforementioned closed circuit thereby to heat the hot cathode K. Next, when the voltage of the a.c. power source $V_1$ restores the shown polarity, the voltage, which is the addition of the voltage of the a.c. power source $V_1$ and the charged voltage of the capacitor $C_2$, is applied between the anode A and the hot cathode K of the discharge lamp DL. As a result, this discharge lamp DL starts its discharge so that it is ignited. The aforementioned mechanism of step-up operation is provided by the Cockcroft-Walton's circuit. This Cockcroft-Walton's circuit is named after J. D. Cockcroft and E. T. S. Walton.

In case a glow starting switch is used, the starting circuit of the present invention can perform its starting operation within one second because its starting voltage is rapidly applied, whereas it takes several seconds, after the power source is switched on, for the starting circuit of the prior art to generate its starting voltage.

Incidentally, the aforementioned Cockcroft-Walton's circuit is exemplified by the circuit which has one group consisting of the diodes $DB_1$ and $D_1$ and the capacitors $C_1$ and $C_2$. Nevertheless, any high voltage can be generated by increasing the number of the groups consisting of the diodes and the capacitors.

Thus, the discharge lamp starting circuit according to the present invention is constructed of the five diodes, the two capacitors having small capacities, and the one switch device. Therefore, the number of the parts used is made far smaller than that of the starting circuits which have been proposed according to the prior art. Moreover, the starting circuit of the present invention can be made highly reliable because it is constructed exclusively of the parts which can ensure high reliability. On the other hand, the full wave rectifier circuit is intrinsically indispensable in case the d.c. discharge lamp is operated with the use of the a.c. power source. Moreover, the capacitors of small capacites are also required for preventing noises. In short, the parts newly required for shortening the time for the starting operation are nothing but the one diode, the one capacitor of small capacity, and the one switch device. In other words, the starting circuit of the present invention can be produced at a remarkably low cost.

Figure 2:
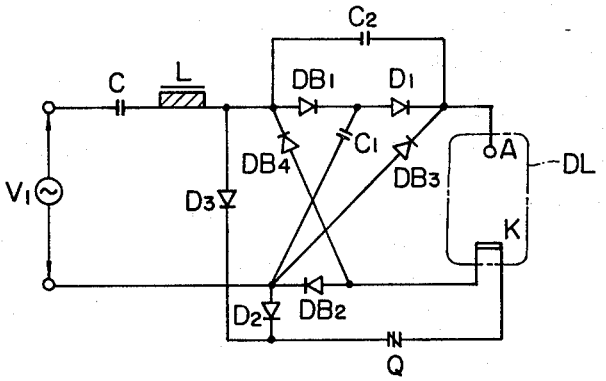
FIG. 2 is a circuit diagram showing another embodiment of the present invention.

FIG. 2 shows the circuit construction of another embodiment of the present invention. In this embodiment, a series circuit composed of a capacitor C and the choke L is used as the current limit device. The choke L may be made to have a sufficiently low inductance because it is sufficient if it can prevent any electric current having high frequencies from being fed back to the a.c. power source $V_1$. Since the current limit device is primarily comprised of the capacitor C, diodes $D_2$ and $D_3$ for converting the preheating current into an alternate current are added to the preheating circuit. Here, the discharge lamp DL, the full wave rectifier circuit and the Cockcroft-Walton's circuit are absolutely identical to those of the embodiment shown in FIG. 1.

The second embodiment under consideration has the following feature in addition to those of the embodiment shown in FIG. 1. Specifically, in the case of the current limit device comprised substantially of the capacitor, no inductance-induced voltage by current interruption is established, if the glow starting switch is used, so that a high voltage for the starting operation cannot be generated. On the contrary, the starting circuit of the present embodiment is sufficient to start the discharge lamp even if a capacitor is utilized as the current limmit device, because it does not utilize an induced voltage for ignition by current interruption.

Incidentally, it goes without saying that the starting circuit according to the present invention can also be applied to a discharge lamp which is equipped with a cathode other than the preheat type cathode.

As has been described hereinbefore, according to the present invention, it is possible to provide a discharge lamp starting circuit which can perform its starting operation within a short time period required and which is inexpensive and highly reliable.

I claim:

1. A starting circuit for discharge lamps, comprising: a discharge lamp operated on direct current and including one preheat type hot cathode and at least one anode; a full wave rectifier circuit having its d.c. output terminal connected between said anode and said cathode; a current limit device connected between the a.c. input terminal of said full wave rectifier circuit and the input terminal of an a.c. power source; a Cockcroft-Walton's circuit formed by adding capacitors and a rectifier to one of the rectifiers which form said full wave rectifier circuit; and circuit means for preheating said cathode, said preheating circuit means including at least one other of the rectifiers which form said full wave rectifier circuit.

2. A starting circuit according to claim 1, wherein said current limit device is a choke.

3. A starting circuit according to claim 1, wherein said current limit device is a series circuit which is composed of a capacitor and a choke.

4. A starting circuit according to claim 1, wherein said rectifiers are semiconductor diodes.

5. A starting circuit according to claim 1, wherein said d.c. discharge lamp is a compact fluorescent lamp with screw in base.

6. A starting circuit according to claim 1, wherein said preheating circuit means further includes switching means connected in series with said cathode.

7. A starting circuit according to claim 6, wherein said switching means experiences self breakdown for being rendered conductive when a voltage applied thereto is higher than a discharge voltage of said d.c. discharge lamp and lower than a peak voltage of said a.c. power source.

8. A starting circuit according to claim 6, wherein said switching means comprises a symmetrical silicon switch.

9. A starting circuit for discharge lamps, comprising: a discharge lamp operated on direct current and including one preheat type hot cathode and at least one anode; a full wave rectifier circuit having its d.c. output terminal connected between said anode and said cathode; a current limit device connected between the a.c. input terminal of said full wave rectifier circuit and the input terminal of an a.c. power source; a Cockcroft-Walton's circuit formed by adding capacitors and a rectifier to one of the rectifiers which form said full wave rectifier circuit; and circuit means for preheating said cathode, said preheating circuit means including switching means connected in series with said cathode, said switching means experiencing self breakdown for being rendered conductive when a voltage applied thereto is higher than a discharge voltage of said d.c. discharge lamp and lower than a peak voltage of said a.c. power source.

10. A starting circuit according to claim 9, wherein said switching means comprises a symmetrical silicon switch.

11. A starting circuit according to claim 9, wherein said preheating circuit means further includes at least one other of the rectifiers which form said full wave rectifier circuit.

12. A starting circuit according to claim 11, wherein said preheating circuit means includes at least one additional rectifier.

13. A starting circuit according to claim 9, wherein said current limit device is a choke.

14. A starting circuit according to claim 9, wherein said current limit device is a series circuit which is composed of a capacitor and a choke.

15. A starting circuit according to claim 9, wherein said rectifiers are semiconductor diodes.

16. A starting circuit according to claim 9, wherein said d.c. discharge lamp is a compact fluorescent lamp with a screw-in base.

* * * * *